US007374360B1

(12) United States Patent
Szekely

(10) Patent No.: US 7,374,360 B1
(45) Date of Patent: May 20, 2008

(54) APPLICATOR FOR PERSONAL CARE COMPOSITIONS

(75) Inventor: Alex S. Szekely, Jackson, NJ (US)

(73) Assignee: Plastek Industries, Inc., Erie, PA (US)

( * ) Notice: Subject to any disclaimer, the term of this patent is extended or adjusted under 35 U.S.C. 154(b) by 183 days.

(21) Appl. No.: 11/402,384

(22) Filed: Apr. 11, 2006

Related U.S. Application Data

(60) Provisional application No. 60/670,500, filed on Apr. 11, 2005.

(51) Int. Cl.
*B43K 1/06* (2006.01)
*B43K 5/06* (2006.01)

(52) U.S. Cl. ..... 401/265; 401/263; 401/175; 222/390

(58) Field of Classification Search ..... 401/263, 401/265, 266, 172, 54, 175; 220/390, 386
See application file for complete search history.

(56) References Cited

U.S. PATENT DOCUMENTS

| | | | | |
|---|---|---|---|---|
| 5,000,356 | A | 3/1991 | Johnson et al. | |
| 5,547,302 | A | 8/1996 | Dornbusch et al. | |
| 5,697,531 | A | 12/1997 | Fattori | |
| 5,839,622 | A * | 11/1998 | Bicknell et al. | 222/390 |
| 5,961,007 | A | 10/1999 | Dornbusch et al. | |
| 6,086,276 | A * | 7/2000 | Gueret | 401/54 |
| 6,143,284 | A | 11/2000 | Bush et al. | |
| 6,450,716 | B1 * | 9/2002 | Szekely | 401/79 |
| 2005/0002883 | A1 | 1/2005 | Chuah et al. | |

* cited by examiner

*Primary Examiner*—David J Walczak
(74) *Attorney, Agent, or Firm*—Bachman & LaPointe, P.C.

(57) ABSTRACT

A dispenser has a multi-piece, multi-material, screw, user-engagable element, and reciprocal compliance spring arrangement.

20 Claims, 2 Drawing Sheets

APPLICATOR FOR PERSONAL CARE COMPOSITIONS

CROSS-REFERENCE TO RELATED APPLICATION

Benefit is claimed of U.S. Patent Application Ser. No. 60/670,500, filed Apr. 11, 2005, and entitled "Applicator for Personal Care Compositions", the disclosure of which is incorporated by reference herein as if set forth at length.

BACKGROUND OF THE INVENTION

The invention relates to personal care. More particularly, the invention relates to applicators for underarm antiperspirant and/or deodorant.

A well-developed art exists regarding dispenser/applicators for personal care products. One particular area involves applicators for solid or gel antiperspirant and/or deodorant compositions. Applicators for solid and gel compositions are typically thoroughly similar to each other, with a piston (platform) upwardly movable within a cylinder (barrel) to progressively drive the composition out the barrel upper end. Due to the relative lack of stiffness of many gels and soft solids, dispensers for such compositions commonly include apertured applicator elements across the upper end of the barrel.

Certain compositions are particularly sensitive to pressure. Accordingly, the imposition of residual pressure after the initial discharge of composition may be problematic. Soft solid compositions (especially those containing silicone oils) are particularly sensitive to pressure-induced microstructural changes. PCT/US98/09656, the disclosure of which is incorporated by reference herein as if set forth at length, discloses exemplary such compositions. Thus pressure relief mechanisms have been provided. Exemplary pressure relief mechanisms are shown in U.S. Pat. Nos. 5,000,356, 5,547,302, 5,697,531, and 5,961,007, and pre-grant publication US2005/0002883. One marketed dispenser resembles the cover page embodiment of the '356 patent, the disclosure of which is incorporated by reference herein as if set forth at length. That dispenser includes a one-piece molded combination elevator screw and handwheel. Superimposed reciprocal movement of the screw is caused by camming interaction of respective groups of ratchet teeth on the molded element and barrel. The downstroke of this superimposed reciprocal movement provides pressure relief. The reciprocal movement is permitted by compliance of spring unitarily formed as a portion of the element. The spring is formed of a spiral-armed flange of the handwheel. The element is formed from a material appropriate for spring operation, specifically Celcon® polyoxymethylene acetal copolymer by Celanese Corporation.

SUMMARY OF THE INVENTION

The present dispenser replaces the one-piece single material screw, handwheel, and reciprocal compliance spring arrangement with a multi-piece arrangement. The exemplary spring is separately-formed from the screw member and the user-engagable element.

In various implementations, the spring may be metallic while the screw member and user-engagable element are polymeric. The separate forming may free the manufacture of the screw member and user-engagable element from the material performance constraints required for the spring. For example, the screw member and user-engagable elements may be manufactured of relatively inexpensive materials such as polypropylene.

The separation may also add economies to manufacture of different combinations. For example, a single spring may be used with different combinations of screw member and user-engagable element for example, with one basic user-engagable element and spring combination, different dispensers may feature differently colored and/or differently shaped user-engagable elements (e.g., handwheels having different contouring, elongate elements in place of handwheels, and the like). With one basic user-engagable element and spring, screws of different length may be used for different sizes of dispensers. Other variations are possible.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
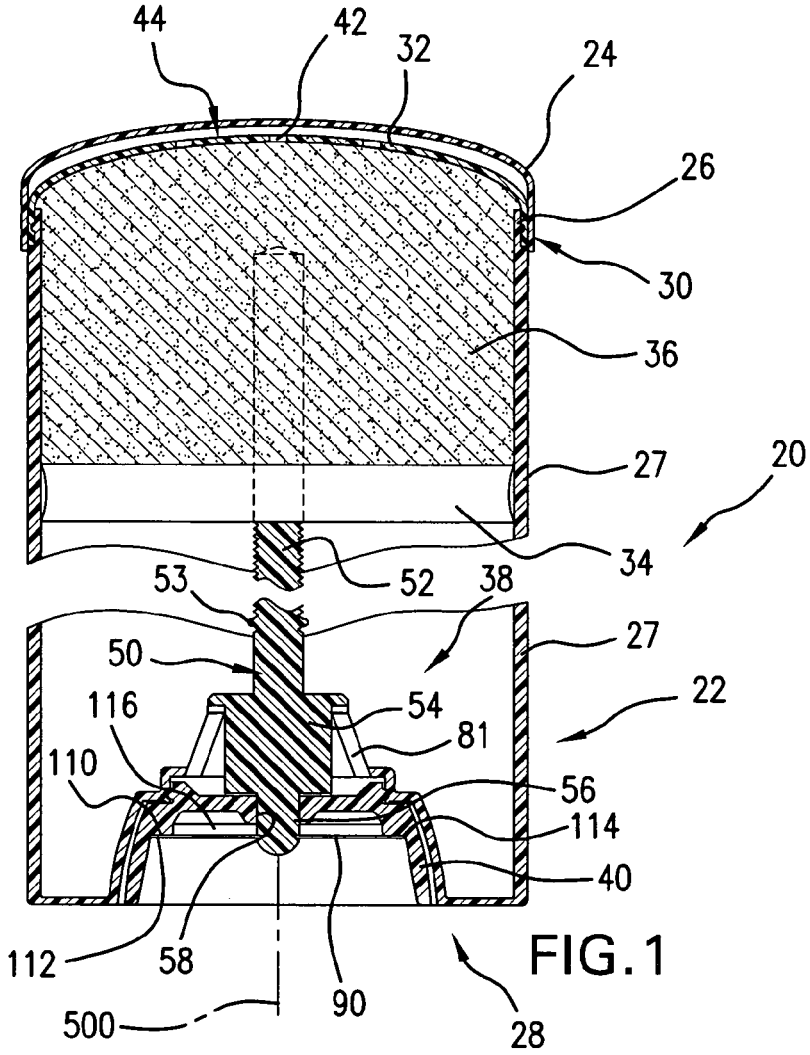
FIG. 1 is a partial cutaway view of a dispenser.

FIG. 1 shows an applicator apparatus 20 having a barrel 22 and a cover 24 in an installed position around a barrel neck 26. The barrel has a sidewall 27 extending along a central longitudinal/vertical axis 500 from a bottom (base) end 28 to an upper end 30. An apertured applicator 32 is secured across (e.g., for a top-fill apparatus) or unitarily formed with (e.g., for a bottom-fill apparatus) the barrel upper end (e.g., around the neck 26 within the cover 24). A platform or piston 34 supports the composition 36 and is, itself, supported by an actuating mechanism 38 (e.g., a screw-type elevator mechanism) having a user-engagable element such as a knob or wheel 40. The wheel 40 may be rotated about the axis 500 for progressively raising the platform toward the barrel upper end so as to discharge the composition. The directions are relative and reference typical product orientations in shipping and display.

With an exemplary semisolid stick composition 36, raising of the piston applies pressure to the composition causing it to extrude through the applicator aperture(s) 42. This increment may be spread by the applicator outer surface 44. Exemplary compositions 36 utilize an anhydrous carrier comprising a mixture of volatile and nonvolatile silicones (e.g., as disclosed in PCT/US98/09656.

Figure 2:
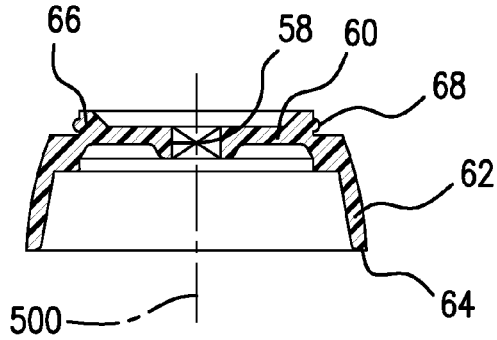
FIG. 2 is a partial cutaway view of a handwheel of the dispenser of FIG. 1.
Figure 4:
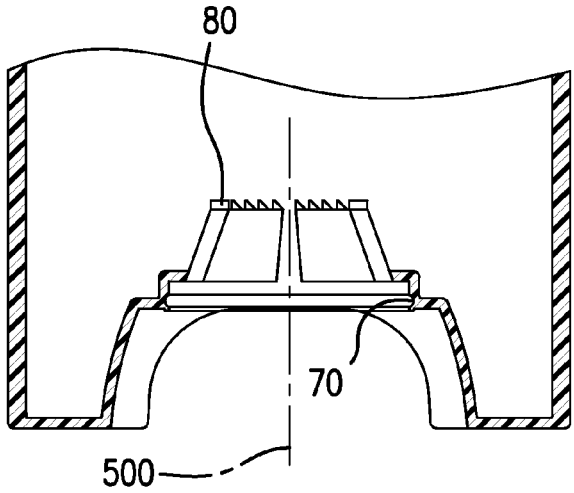
FIG. 4 is a partial cutaway view of a lower end of the dispenser of FIG. 1.

As heretofore described, the apparatus 20 may be of any of a wide variety of known or yet-developed configurations. FIG. 1, however, shows further details of the exemplary implementation of the actuating mechanism 38. The wheel is separately formed from a screw member 50. The screw member 50 includes a threaded distal portion 52 for threaded engagement of a receiving aperture of the piston. A proximal portion 54 of the screw member 50 is configured for coupling to the wheel 40. The exemplary coupling involves a square-sectioned lower end 56 of the proximal portion 54 received within a complementary square aperture 58 (FIG. 2) in an upper web 60 of the wheel 40. The upper web 60 is at the upper end of a user-gripable sidewall 62 extending to a bottom rim 64. A collar 66 extends upward from the web 60 and has a radial rib or projection 68 received in a complementary groove 70 (FIG. 4) in the barrel. Cooperation of the projection 68 and groove 70 retains the wheel 40 longitudinally (vertically as shown) in the barrel while permitting the rotation about the axis 500.

Figure 5:
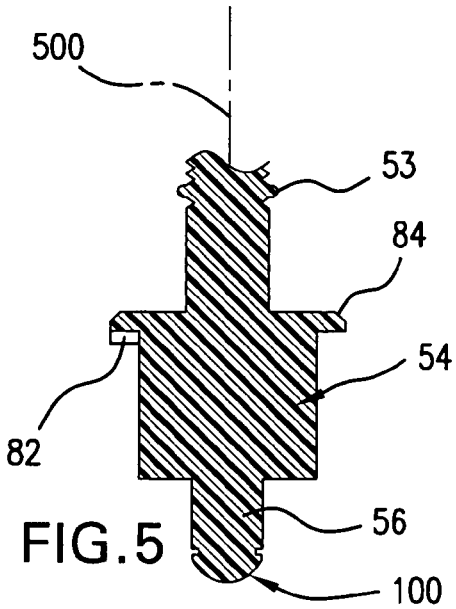
FIG. 5 is a partial cutaway view of a screw member of the dispenser of FIG. 1.
Figure 3:
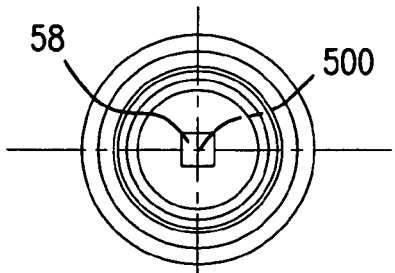
FIG. 3 is a top view of the handwheel of FIG. 2.

To provide the superimposed pressure-relief motion, the barrel is provided with a circumferential array of upwardly-directed teeth 80 at the upper end of a circumferential array of leaves 81. A complementary array of teeth 82 (FIG. 5) depend from a flange 84 at the upper end of the screw member proximal portion 54. An exemplary magnitude of the pressure relief motion is about 0.035 inch (e.g., 0.01-0.06 inch)

Figure 6:
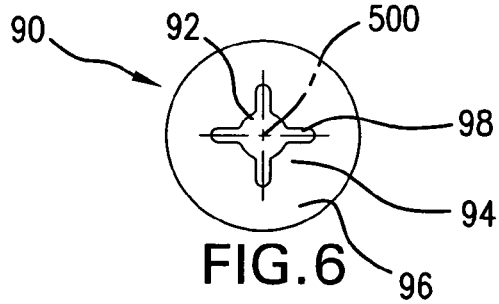
FIG. 6 is a plan view of a plate spring of the dispenser of FIG. 1.

As the wheel 40 is rotated in a first direction about the axis 500, the piston is raised relative to the screw member 50. Additionally, in a first increment, a camming interaction between the teeth raises the screw member and piston relative to the barrel. This raising of the screw member 50 stresses a spring 90. The spring 90 provides a return force between the screw member 50 and the wheel 40. The exemplary spring 90 is formed of sheet metal (e.g., stainless steel). The exemplary spring 90 has a central aperture 92 (FIG. 6) toward which a plurality of flexible fingers 94 extend from a periphery 96. The fingers are separated by slots 98.

Figure 7:
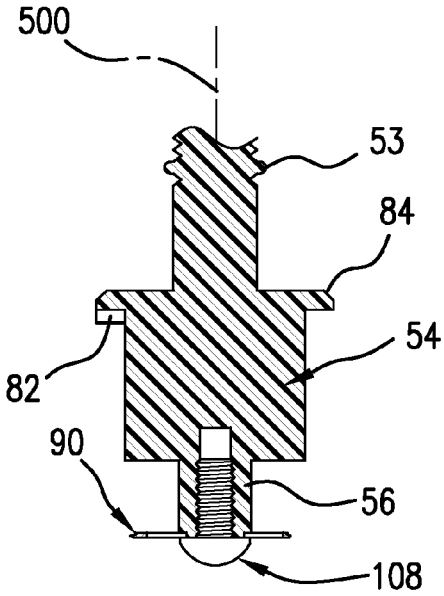
FIG. 7 is a partial cutaway view of an alternate screw member.

Tip portions of the fingers 94 are engaged to the screw member. Exemplary engagement is by a mechanical back-locking. For example, the spring may be snapped over a dome or other tapering portion of a protuberance 100 unitarily molded as part of the screw 50 at the lower end thereof. The head underside contacts a spring underside to act as a barb at the lower end of the screw member 50 (e.g., facilitating a one-way insertion after assembly). Alternative engagements include use of a separate fastener 108 (FIG. 7) (e.g., a stainless steel screw or a molded plastic snap fastener). The spring upper face 110 (FIG. 1) along the periphery 96 contacts an underside 112 of an annular shoulder 114 of the user-engagable element 40. A relieved area 116 inboard of the shoulder below the web 60 permits upward flexing of the spring fingers due to the upstroke of the reciprocal motion provided by the camming engagement of the teeth.

When the teeth pass out of their camming engagement, the spring returns the screw member to its lower position and, thereby, slightly returns the piston to reduce pressure on the composition. This may prevent residual extrusion of the composition and further microstructural change. The exemplary longitudinally protruding teeth 80 and 82 cooperate to form a ratchet substantially preventing rotation opposite the first direction. In the exemplary operation, various components other than the spring and screw (if present) are molded from appropriate plastics. For example, the exemplary wheel 40 may consist essentially of a polypropylene first piece; the screw member 50 may consist essentially of a polypropylene second piece; and the spring may consist essentially of a third piece not essentially of propylene (e.g. essentially of steel). The wheel and screw may respectively consist essentially of first and second pieces not essentially of acetal copolymer while the spring may consist essentially of a third piece of material dissimilar to at least one of the first and second pieces. The spring may be stamped. The invention may be applied to either top-fill or bottom-fill apparatus. As noted above various manufacturing economies may be facilitated. Pluralities of first dispensers and second dispensers may be manufactured. The screw members of the first and second dispensers may be identical whereas the wheels may be not identical. Alternatively the screw members may be not identical while the wheels may be identical. The springs of the first and second dispensers may be identical while the compositions contained therein may be not identical.

In an exemplary top-fill implementation, dispenser may be partially preassembled, as follows. The actuating mechanism 38 may be assembled. The piston may be inserted through the upper end and bottomed. The screw threaded distal portion 52 may be inserted through the barrel lower end and screwed into the piston aperture until a stop 53 thereon hits the piston. Then, the mechanism 38 may be pushed up a final bit so that the flange 84 passes along and outwardly flexes leaves 81 and then release the leaves to permit engagement of the teeth 80 and 82 and capture of the rib 68 in the channel/groove 70. After the preassembly, the dispensers may be boxed and shipped to a filler. The filler may fill the barrel with the composition atop the piston. The filler may then place the applicator (e.g., including a removeable foil seal) over the barrel upper end and then place the cap over the applicator.

One or more embodiments of the present invention have been described. Nevertheless, it will be understood that various modifications may be made without departing from the spirit and scope of the invention. For example, the principles may be applied in the reengineering of an existing applicator configuration or in a clean sheet engineering. If a reengineering, details of the existing configuration may influence details of any given implementation. Additionally, to the extent that existing manufacturing equipment is desired to be used this may also influence the associated implementation. Accordingly, other embodiments are within the scope of the following claims.

What is claimed is:

1. A personal care dispenser/applicator apparatus comprising:

a barrel having:
- a bottom end;
- a top end; and
- a sidewall extending between the bottom end and the top end;

a piston upwardly moveable within the barrel from a first position to a second position;

a body of a personal care composition at least partially within the barrel between the piston and the top end; and an actuator coupled to the piston to shift the piston upward and comprising:
- a user-engagable element;
- a screw member having:
  - a threaded first portion engaged to the piston for relative rotation about a first axis; and
  - a second portion engaged to the user-engagable element to permit a user-induced rotation of the user-engageable element about the first axis to, in turn, rotate the first portion while accommodating a shift of the screw member relative to the user-engageable element along the first axis; and a spring, separately formed from the user-engageable element and the screw member and coupled to the screw member and user engageable member to bias the screw member from a relatively raised first position to a relatively lowered second position, wherein:

interfitting portions of the user-engageable member and the barrel cooperate to retain the user-engageable member against translation along the first axis but hold the user engageable member for rotation around the first axis.

2. The apparatus of claim 1 wherein:

the barrel has first camming members; and the screw member has second camming members cooperating with the first camming members so that rotation of the user-engageable member in a first direction about the first axis causes a camming interaction of the first and second camming members to lift the screw member from the second position to the first position against a force from the spring and then release the screw member to return to the second position.

3. The apparatus of claim 2 wherein:

the first camming members and second camming members are pluralities of longitudinally protruding teeth cooperating to form a ratchet substantially preventing rotation opposite said first direction.

4. The apparatus of claim 1 wherein:

the spring is a sheet steel spring having a plurality of flexing portions extending inward to a central aperture and separated by slots; and the screw member is retained to the spring by one of:

a separate fastener; and a barb on the screw member.

5. The apparatus of claim 1 wherein:

the spring is a sheet steel spring having a plurality of flexing portions extending inward to a central aperture and separated by slots; and the screw member is retained to the spring by a barb on the screw member.

6. The apparatus of claim 1 wherein:

the user-engageable member consists essentially of a polypropylene first piece;

the screw member consists essentially of a polypropylene second piece; and the spring consists essentially of a third piece, not essentially of polypropylene.

7. The apparatus of claim 1 wherein:

the composition is a soft stick antiperspirant; and the apparatus has an apertured applicator portion proximate the barrel top and optionally unitarily-formed therewith, upward movement of the piston causing an extrusion of the composition through the applicator.

8. The apparatus of claim 1 wherein:

the user-engageable member consists essentially of a first piece not essentially of acetal copolymer;

the screw member consists essentially of a second piece not essentially of acetal copolymer; and the spring consists essentially of a third piece of material dissimilar to at least one of the first and second pieces.

9. A method comprising:

manufacturing a plurality of first apparatus according to claim 1; and manufacturing a plurality of second apparatus according to claim 1;

wherein one of:

the screw members of the first and second apparatus are identical while the user-engageable members of the first and second apparatus are not identical; and the screw members of the first and second apparatus are not identical while the user-engageable members of the first and second apparatus are identical.

10. The method of claim 9 wherein:

the springs of the first and second apparatus are identical while the compositions of the first and second apparatus are not identical.

11. A personal care dispenser/applicator apparatus for dispensing a personal care composition, the apparatus comprising:

a barrel having:

a bottom end;

a top end; and a sidewall extending between the bottom end and the top end;

an apertured applicator proximate the barrel top end;

a piston upwardly moveable within the barrel from a first position to a second position;

a body of a personal care composition at least partially within the barrel between the piston and the applicator; and an actuator coupled to the piston to shift the piston upward and comprising:

a user-engagable element;

a screw member having:

a threaded first portion engaged to the piston for relative rotation about a first axis; and a second portion engaged to the user-engagable element to permit a user-induced rotation of the user-engageable element about the first axis to, in turn, rotate the first portion while accommodating a shift of the screw member relative to the user-engageable element along the first axis; and a spring, separately formed from the user-engageable element and the screw member and coupled to the screw member and user engageable member to bias the screw member from a relatively raised first position to a relatively lowered second position, wherein:

interfitting portions of the user-engageable member and the barrel cooperate to retain the user-engageable member against translation along the first axis but hold the user engageable member for rotation around the first axis.

12. The apparatus of claim 11 wherein:

the applicator and barrel are a single unitary molding.

13. A personal care dispenser/applicator apparatus for dispensing a personal care composition, the apparatus comprising:

a barrel having:

a bottom end;

a top end; and a sidewall extending between the bottom end and the top end;

an apertured applicator proximate the barrel top end;

a piston upwardly moveable within the barrel from a first position to a second position; and an actuator coupled to the piston to shift the piston upward and comprising:

a user-engagable element;

a screw member having:

a threaded first portion engaged to the piston for relative rotation about a first axis; and a second portion engaged to the user-engagable element to permit a user-induced rotation of the user-engageable element about the first axis to, in turn, rotate the first portion while accommodating a shift of the screw member relative to the user-engageable element along the first axis; and means for providing residual pressure after a discharge of composition and comprising at least one element separately formed from the user-engageable element and the screw member, the means having a first portion engaging the user-engagable element and a second portion engaging the screw member.

14. The apparatus of claim 13 wherein:

the composition is a soft stick antiperspirant.

15. The apparatus of claim 13 wherein:

the means comprises a sheet steel spring;

the first portion of the means comprises a peripheral portion;

the second portion of the means comprises a central aperture; and the user-engagable element comprises a wheel.

16. A personal care dispenser/applicator apparatus comprising:

a barrel having:

a bottom end;

a top end; and a sidewall extending between the bottom end and the top end;

a piston upwardly moveable within the barrel from a first position to a second position;

a body of a personal care composition at least partially within the barrel between the piston and the top end; and an actuator coupled to the piston to shift the piston upward and comprising:

a user-engagable element;

a screw member having:

a threaded first portion engaged to the piston for relative rotation about a first axis; and a second portion engaged to the user-engagable element to permit a user-induced rotation of the user-engageable element about the first axis to, in turn, rotate the first portion while accommodating a shift of the screw member relative to the user-engageable element along the first axis; and a spring, separately formed from the user-engageable element and the screw member and coupled to the screw member and user engageable member to bias the screw member from a relatively raised first position to a relatively lowered second position, the spring comprising a sheet having a central portion engaging the screw member and a peripheral portion engaging the user-engagable element so as to provide said bias via flexing.

17. The apparatus of claim 16 wherein:

the spring has a plurality of flexing portions extending inward to a central aperture and separated by slots; and the screw member is retained to the spring by one of:

a separate fastener; and a barb on the screw member.

18. The apparatus of claim 17 wherein:

the spring is a sheet steel spring.

19. The apparatus of claim 17 wherein:

the spring is a sheet steel spring.

20. The apparatus of claim 16 wherein:

the spring has plurality of flexing portions extending inward to a central aperture and separated by slots; and the screw member is retained to the spring by a barb on the screw member.

* * * * *